US007510373B2

(12) United States Patent
Sarri

(10) Patent No.: US 7,510,373 B2
(45) Date of Patent: Mar. 31, 2009

(54) MULTISTAGE CENTRIFUGAL COMPRESSOR

(75) Inventor: Franco Sarri, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 204 days.

(21) Appl. No.: 10/595,731

(22) PCT Filed: Nov. 4, 2004

(86) PCT No.: PCT/EP2004/012577

§ 371 (c)(1),
(2), (4) Date: May 8, 2006

(87) PCT Pub. No.: WO2005/045252

PCT Pub. Date: May 19, 2005

(65) Prior Publication Data

US 2007/0122273 A1 May 31, 2007

(30) Foreign Application Priority Data

Nov. 7, 2003 (IT) ..... MI2003A2148

(51) Int. Cl.
*F01D 1/02* (2006.01)

(52) U.S. Cl. ..... 415/199.1; 415/199.2

(58) Field of Classification Search ..... 415/199.1, 415/199.2, 214.1
See application file for complete search history.

(56) References Cited

U.S. PATENT DOCUMENTS

| | | | | |
|---|---|---|---|---|
| 3,370,542 | A * | 2/1968 | Harney | 415/47 |
| 3,861,825 | A | 1/1975 | Blom et al. | |
| 4,715,778 | A | 12/1987 | Katayama et al. | |
| 6,884,031 | B2 * | 4/2005 | Gregory | 415/199.2 |

FOREIGN PATENT DOCUMENTS

| | | | |
|---|---|---|---|
| CH | 350408 | A | 11/1960 |
| FR | 1515450 | A | 3/1968 |
| GB | 754322 | A | 8/1956 |
| GB | 765145 | A | 1/1957 |
| GB | 1309716 | A | 3/1973 |

* cited by examiner

*Primary Examiner*—Igor Kershteyn
(74) *Attorney, Agent, or Firm*—GE Global Patent Operation

(57) ABSTRACT

Multistage centrifugal compressor includes at least one stage which, in turn, has a lower half-tank, an upper half-tank, a series of lower half-diaphragms, a shaft equipped with a series of rotors, a series of upper half-diaphragms, a lower suction half-diaphragm, an upper suction half-diaphragm, the lower suction half-diaphragm and the upper suction half-diaphragm include a lower portion (71) and an upper portion (72), respectively, suitable for being coupled with the lower half-diaphragms and with the upper half-diaphragms, respectively, to form a first pile of lower half-diaphragms and a second pile of upper half-diaphragms, respectively.

7 Claims, 1 Drawing Sheet

MULTISTAGE CENTRIFUGAL COMPRESSOR

CROSS-REFERENCE TO RELATED APPLICATIONS

Not Applicable

BACKGROUND OF THE INVENTION

1. Field of the Invention

The present invention relates to a multistage centrifugal compressor having a tank which can be opened horizontally.

2. Description of the Related Art

The fundamental elements forming a multistage centrifugal compressor are a shaft equipped with a series of rotors, rotating round the machine axis, and a series of diffusers and/or diaphragms with return channels between the various stages, integral with a tank which contains the compressor.

Each rotor consists of a series of bladed disks; all rotors are assembled on the same shaft.

A diffusor follows each rotor disk.

Each diffusor is associated with a bladed return channel, which conveys the fluid to the subsequent rotor.

The whole set of each rotor together with the relative diffusers and return channels forms a stage, which is separated from the adjacent ones by annular diaphragms and labyrinth-seal systems to avoid recycling between one stage and the other.

The centrifugal compressors are equipped with diaphragms consisting of two half-diaphragms.

During the functioning of the multistage centrifugal compressor, the diaphragms are subjected to an axial force caused by the pressure differences due to compression of the fluid.

In order to counterbalance this force, it is therefore necessary to fix the half-diaphragms to the stator of the multistage centrifugal compressor.

In centrifugal compressors equipped with a tank which can be opened into two halves, a supporting ring is therefore envisaged for each single diaphragm, which is integral with the tank and is divided into an upper half-ring and a lower half-ring.

Each lower half-ring is welded to the lower, half-tank, and the corresponding upper half-ring is welded to the upper half-tank.

Each upper half-diaphragm is fixed to the corresponding upper half-ring, whereas each lower half-diaphragm is fixed to the corresponding lower half-ring.

This is due to the fact that the half-diaphragms undergo axial stress during the functioning of the compressor and, without the supporting rings, they would tend to move, causing, among other things, sealing problems among the various stages.

The assembly of the half-diaphragms in the tanks is extremely difficult, as it is necessary to centre all the half-diaphragms with the respective half-rings and also to centre the lower half-diaphragms with the corresponding upper half-diaphragms.

At the same time, it is extremely important to keep the seal between the various stages of the centrifugal compressor.

For this reason, the half-diaphragms are always fixed in advance to the corresponding half-rings.

In the assembly of a multistage centrifugal compressor, all the lower half-diaphragms are first inserted into the lower tank, followed by the shaft with the rotors.

Similarly, the upper half-diaphragms are inserted and fixed to the upper tank.

The upper tank can be assembled on the lower tank after being lifted by means of a bridge-crane, overturned by a rotation of 180° and correctly placed on the lower half-tank, in order to perfectly centre all the lower half-diaphragms.

High capacity/pressure multistage centrifugal compressors can be extremely heavy, up to 350 tons, and consequently the upper tank, with the upper half-diaphragms fixed, can weigh even 150-200 tons.

One of the disadvantages is that costly lifting systems are necessary, capable of lifting the total weight of the upper tank on which the upper half-rings have been welded and the upper half-diaphragms respectively fixed to the upper half-rings.

Another disadvantage is that it is not possible to effect controls on the positioning of the components inside the tank.

Furthermore, with respect to maintenance, a relatively common operation, such as the substitution of the labyrinth seal system, requires the overturning of the upper tank.

A further disadvantage is that in the case of particularly large and heavy machines, the overturning of the upper tank requires costly and complex equipment.

SUMMARY OF THE INVENTION

The objective of the present invention is to provide a multistage centrifugal compressor which is simple and with reduced costs and production times.

A further objective is to provide a multistage centrifugal compressor having reduced costs and assembly times.

Another objective is to provide a multistage centrifugal compressor which allows a higher safety level during maintenance operations.

A further objective is to provide a multistage centrifugal compressor which allows the dimension of the bridge-crane, necessary for assembling the multistage centrifugal compressor, to be reduced.

Yet another object is to provide a multistage centrifugal compressor which can pass from the configuration with a tank which can be opened horizontally, to the configuration with a tank which can be opened vertically and viceversa.

A further objective is to provide a multistage centrifugal compressor which allows reduced maintenance costs and times.

These objectives, according to the present invention, are achieved by producing a multistage centrifugal compressor having at least one stage which, in turn, comprises a lower half-tank, an upper half-tank, a series of lower half-diaphragms, a shaft equipped with a series of rotors, a series of upper half-diaphragms, a lower suction half-diaphragm, an upper suction half-diaphragm, such that the lower suction half-diaphragm and the upper suction half-diaphragm include a lower portion suitable for being coupled with the lower half-diaphragms and an upper portion suitable for being coupled with the upper half-diaphragms, to form a first pile of lower half-diaphragms and a second pile of upper half-diaphragms, respectively.

DESCRIPTION OF THE DRAWING

The characteristics and advantages of a multistage centrifugal compressor according to the present invention, will appear more evident from the following illustrative and non-limiting description, referring to the enclosed schematic drawings, in which.

DETAILED DESCRIPTION

Figure 1:
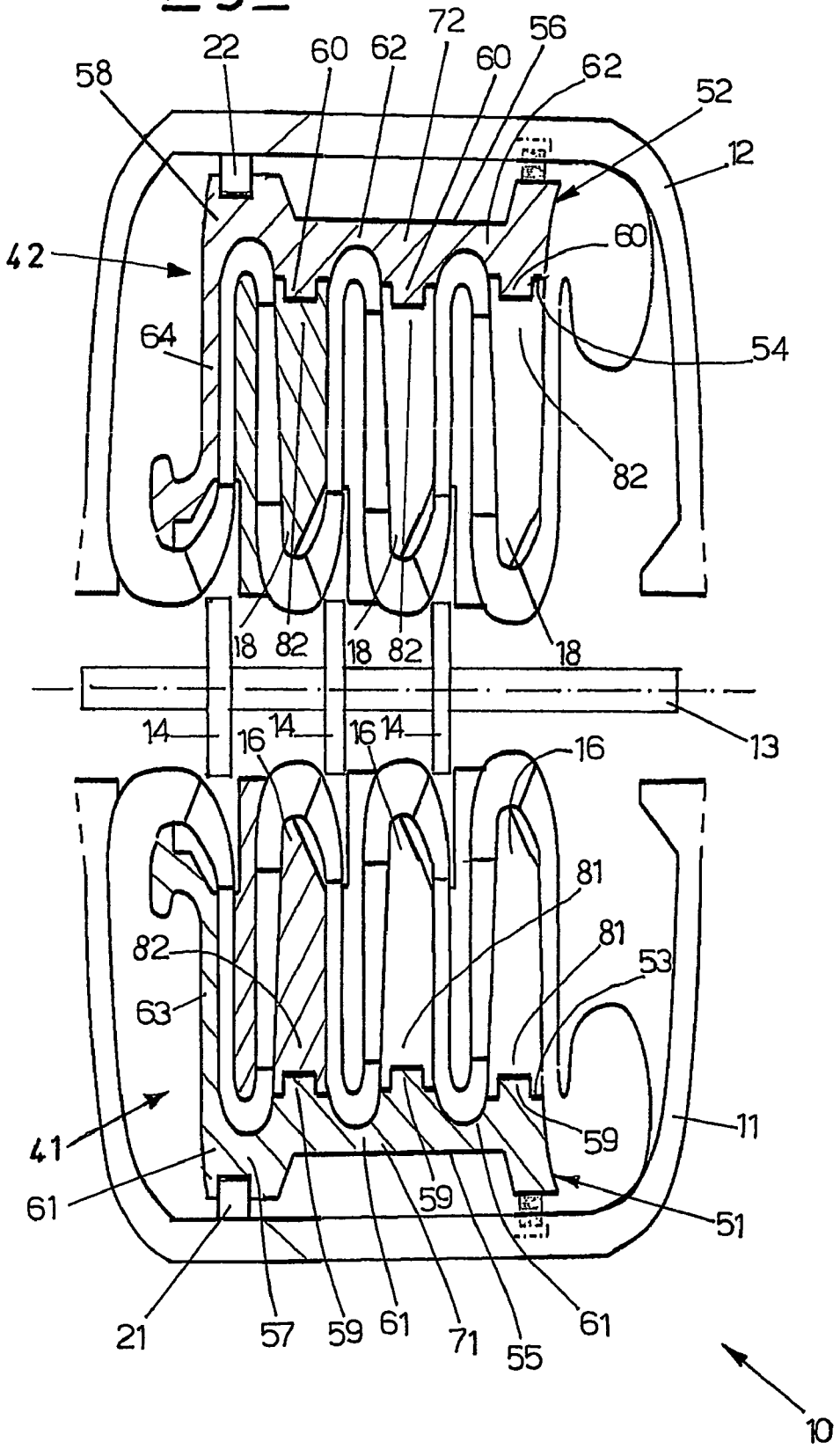
FIG. 1 is a raised, partially sectional, schematic side view, of a stage of a multistage centrifugal compressor, according to the present invention.

With reference to the figures, these show a multistage centrifugal compressor comprising at least one stage 10, which includes a lower half-tank 11 and an upper half-tank 12, a shaft 13 equipped with a series of rotors 14, a series of lower half-diaphragms 16, a series of upper half-diaphragms 18, a lower suction half-diaphragm 51 and an upper suction half-diaphragm 52.

The at least one stage 10 preferably comprises also a lower half-ring 21 and an upper half-ring 22 fixed to the lower half-tank 11 and to the upper half-tank 12, respectively.

In the at least one stage 10, the lower half-diaphragms 16 and the lower suction half-diaphragm 51 are packed and rigidly constrained to one another so as to form a first pile 41 of lower half-diaphragms.

Correspondingly, in the at least one stage 10, the upper half-diaphragms 18 and the upper suction half-diaphragm 52 are piled up and tightly constrained to one another so as to form a second pile 42 of upper half-diaphragms.

According to a preferred embodiment, the lower suction half-diaphragm 51 includes a lower portion or section 71 ("lower portion") suitable for being coupled and for constraining the lower half-diaphragms 16 which are present in the relative stage 10, so as to form the first pile 41 of lower half-diaphragms 16.

The lower portion 71 of the lower suction half-diaphragm 51 has a substantially half-cylinder form, with a shaped inner surface 53 and an outer cylindrical surface 55.

On the outer cylindrical surface 55, there is a radial groove 57, close to a first end of the lower suction half-diaphragm 51, suitable for being coupled with the lower half-ring 21 to balance the axial stress received by the lower half-diaphragms 16 during the functioning of the multistage centrifugal compressor.

The lower suction half-diaphragm 51 comprises a series of inner annular housings 59, each of which is suitable for being coupled with a lower half-diaphragm 16.

The lower suction half-diaphragm 51 also includes a series of shaped radial grooves 61 which act as return channels of the multistage centrifugal compressor.

The annular housings 59, having a minimum diameter, are obtained on the inner surface 53 and are separated from each other by the radial shaped grooves 61.

The lower suction half-diaphragm 51 includes a section with a shaped base 63, open at the center for housing the shaft 13, positioned at the first end of the lower suction half-diaphragm 51.

Correspondingly, the upper suction half-diaphragm 52 is identical to the respective lower suction half-diaphragm 51, and includes an upper portion or section 72 ("upper portion") which is suitable for being coupled and for constraining the upper half-diaphragm 18 present in the relative stage 10, so as to form the second pile 42 of upper half-diaphragms 18.

Analogously to what is described above, the upper suction half-diaphragm 52 comprises the same surfaces and sections, with the same functions, which are respectively indicated by a number which is one unit higher than those of the lower suction half-diaphragm 51.

Each lower half-diaphragm 16 preferably comprises a lower section 81 suitable for being respectively coupled with an internal annular housing 59 of the relative lower suction half-diaphragm 51, and, similarly, each upper half-diaphragm 18 includes an upper section 82 suitable for being respectively coupled with an internal annular housing 60 of the relative upper suction half-diaphragm 52.

The multistage centrifugal compressor can be advantageously easily adapted to the configuration with a horizontal or vertical opening of the tank.

It is advantageously possible to produce the series of lower inner annular housings 59 and upper inner annular housings 60, by means of die-casting or pressure die-casting techniques, with a high probability of reusing the moulds for the production of the same.

The shapes of the lower half-diaphragms 16 and upper half-diaphragms 18 are advantageously standardized, so that they can be produced starting from die-casting or pressure die-casting or from semi-finished products which are more easily available, as a lower thickness is necessary.

Furthermore, the subsequent processing operations for removing shavings is much simpler and more economical both in terms of cost and time.

It can therefore be seen that the multistage centrifugal compressor according to the present invention achieves the objectives mentioned above.

The multistage centrifugal compressor of the present invention, thus conceived, can be subjected to numerous modifications and variations, all included within the same inventive concept.

Furthermore, the materials used, as also their dimensions and components, can vary according to technical requirements.

The invention claimed is:

1. A multistage centrifugal compressor comprising at least one stage which, in turn, comprises a lower half-tank and an upper half-tank to contain the at least one stage, a series of lower half-diaphragms, a shaft equipped with a series of rotors, a series of upper half-diaphragms, a lower suction half-diaphragm, and an upper suction half-diaphragm, wherein the lower suction half-diaphragm and the upper suction half-diaphragm include a lower portion and an upper portion, respectively, suitable for being coupled with the lower half-diaphragms and with the upper half-diaphragms, respectively, to form a first pile of lower half-diaphragms and a second pile of upper half-diaphragms, respectively.

2. The multistage centrifugal compressor according to claim 1, wherein each of the lower portion and the upper portion is shaped cylindrical form comprising a series of annular housings suitable for being coupled with the lower and the upper half-diaphragms respectively, for balancing the axial stress received during the functioning of the multistage centrifugal compressor.

3. The multistage centrifugal compressor according to claim 1, wherein each of the lower half-diaphragm and upper half-diaphragm includes a lower section and an upper section, respectively, suitable for being respectively coupled with an internal annular housing of the relative suction half-diaphragm.

4. The multistage centrifugal compressor according to claim 1, wherein each of the lower suction half-diaphragm and the upper suction half-diaphragm comprises a series of radial shaped grooves.

5. The multistage centrifugal compressor according to claim 1, wherein each of the lower suction half-diaphragm and the upper suction half-diaphragm includes a section with a shaped base, open at the center.

6. The multistage centrifugal compressor according to claim 1, wherein the lower suction half-diaphragm and the upper suction half-diaphragm respectively include supporting feet to adapt the multistage centrifugal compressor to the configuration with a horizontal opening of the tank.

7. The multistage centrifugal compressor according to claim 1, wherein each of the first pile and the second pile, when combined with the shaft, allow the compressor to be assembled horizontally.

* * * * *